US008847788B2

(12) United States Patent
Borland et al.

(10) Patent No.: US 8,847,788 B2
(45) Date of Patent: Sep. 30, 2014

(54) TRAFFIC MANAGEMENT

(71) Applicant: Caterpillar Inc., Peoria, IL (US)

(72) Inventors: Brad K. Borland, Peoria, IL (US); Brian G. Funke, Peoria, IL (US); Mathew Chacko, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 20 days.

(21) Appl. No.: 13/677,377

(22) Filed: Nov. 15, 2012

(65) Prior Publication Data

US 2014/0132422 A1 May 15, 2014

(51) Int. Cl.
*G08G 1/07* (2006.01)

(52) U.S. Cl.
USPC ..... 340/906; 340/907; 340/916; 340/918

(58) Field of Classification Search
CPC ..... G08G 1/00; G08G 1/017; G08G 1/07; G08G 1/09; G08G 1/091; G08G 1/095; G08G 1/123
USPC ..... 340/902, 905, 906, 907, 915, 917, 929, 340/933, 935, 916, 918; 701/123, 300, 302
See application file for complete search history.

(56) References Cited

U.S. PATENT DOCUMENTS

| | | | | |
|---|---|---|---|---|
| 4,704,610 | A * | 11/1987 | Smith et al. | 340/906 |
| 5,777,564 | A * | 7/1998 | Jones | 340/917 |
| 6,243,026 | B1 * | 6/2001 | Jones et al. | 340/906 |
| 6,278,941 | B1 | 8/2001 | Yokoyama | |
| 6,396,417 | B2 * | 5/2002 | Lee | 340/904 |
| 7,251,561 | B2 | 7/2007 | Dotan et al. | |
| 7,283,904 | B2 * | 10/2007 | Benjamin et al. | 701/117 |
| 7,327,280 | B2 * | 2/2008 | Bachelder et al. | 340/906 |
| 7,424,363 | B2 | 9/2008 | Cheng et al. | |
| 2010/0045484 | A1 * | 2/2010 | Brynielsson | 340/906 |

* cited by examiner

*Primary Examiner* — Van T. Trieu
(74) *Attorney, Agent, or Firm* — Finnegan, Henderson, Farabow, Garrett & Dunner LLP

(57) ABSTRACT

Methods and systems for traffic management are disclosed. Location information and a vehicle identifier for a vehicle are received. A current status of the vehicle is determined. Further, it is determined whether the vehicle is located within a defined distance from a lane intersection. A traffic indicator is generated when the vehicle is located within the pre-defined distance from the lane intersection. The traffic indicator is one of a Right of Way (ROW), Stop, Yield or Null. The generated traffic signal is transmitted back to the vehicle.

18 Claims, 4 Drawing Sheets

TRAFFIC MANAGEMENT

TECHNICAL FIELD

The present disclosure relates to traffic management, and in particular, to traffic management in lane based systems.

BACKGROUND

Traffic management systems are employed for various purposes such as traffic control, fleet management, mine management, and the like. One such traffic management system is disclosed in U.S. Pat. No. 6,278,941 (the '941 patent). The '941 patent discloses a route guide system for displaying the present position of a vehicle on a screen when traveling in a known area. A navigation apparatus is mounted on a car that stores map data in it, and displays a map of an area around a present position and the present position together. To reduce the amount of stored data and the burden of processing on the navigation apparatus, a traveling route to a destination from a center apparatus is received in case that a traveling route guidance to the destination is needed. Data of the whole traveling route to a destination are not transmitted at one time but data of only a traveling route from the present position to a specific distance ahead are transmitted at one time and thereby it is possible to reduce the amount of data of communication and start the car earlier. It is possible to transmit the optimum traveling route in consideration of the latest traffic information by newly finding a traveling route to the destination before each transmission of a divided route.

The above disclosed traffic management system may be useful for obtaining navigational routes from a current position, however, such systems may be incompetent during traffic management for one or more lanes intersecting with each other and also when different types of vehicles are travelling in a closed geographical terrain, such as that of a mining location. The present disclosure is directed to overcoming one or more of the problems as set forth above.

SUMMARY

In one aspect of the present disclosure, a method for traffic management is disclosed. The method includes receiving location information and a vehicle identifier associated with a vehicle. The method further includes determining a current status of the vehicle and if the vehicle is located within a defined distance from a lane intersection. A traffic indicator based on the current status of the vehicle is generated in response to determining that the vehicle is located within the defined distance from the lane intersection. The traffic indicator is one of a Right to Way (ROW), Stop, Yield and Null. The traffic indicator is transmitted to the vehicle.

In another aspect of the present disclosure, a traffic management system is disclosed. A receiving module of the traffic management system is configured to receive location information and a vehicle identifier associated with a vehicle and further configured to transmit a traffic indicator to the vehicle. The traffic management system further includes a status module configured to determine a current status of the vehicle and determine if the vehicle is located within a defined distance from a lane intersection and a traffic management module configured to generate the traffic indicator based on the current status of the vehicle, wherein the traffic indicator is generated in response to determining if the vehicle is located within the defined distance from the lane intersection. The traffic indicators include ROW, Stop, Yield and Null.

Other features and aspects of this disclosure will be apparent from the following description and the accompanying drawings.

DETAILED DESCRIPTION

Figure 1:
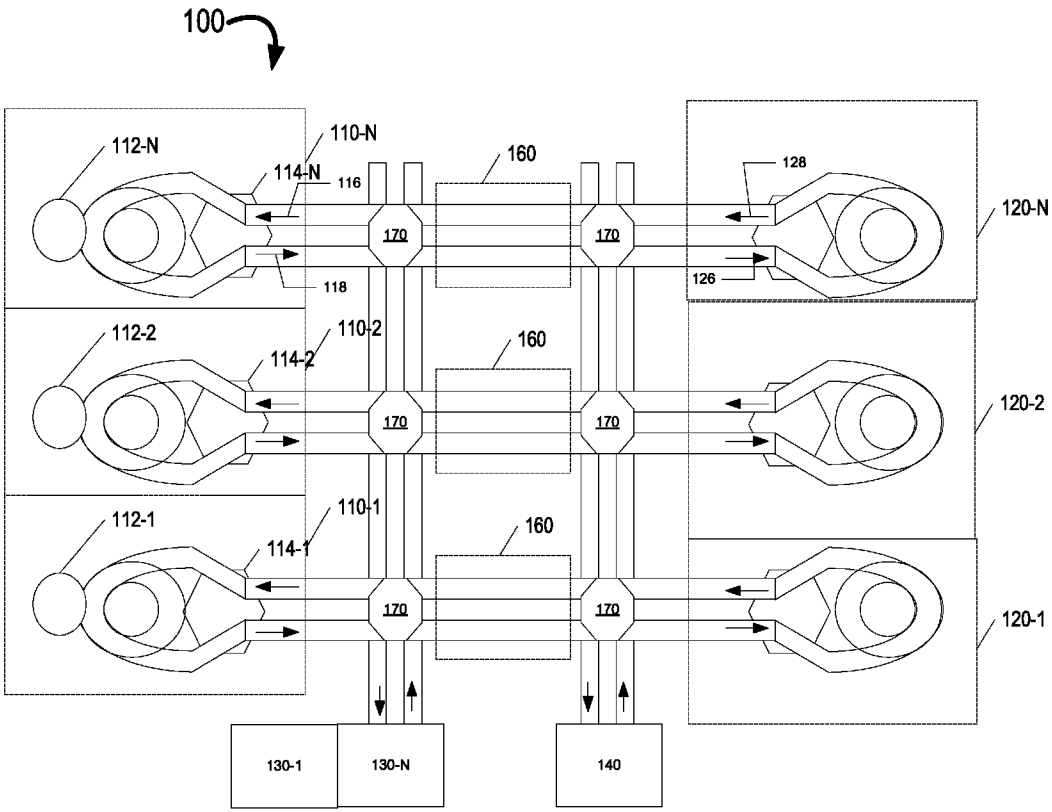
FIG. 1 is an exemplary mine map, in accordance with an embodiment of the present disclosure.

FIG. 1 illustrates an exemplary mine map 100. Mine map 100 represents a layout of the surface of a typical mine site.

Mine map 100 includes diagrammatical illustrations of one or more quarries 110-1, 110-2 . . . 110-N (collectively referred to as quarries 110), one or more dump zones 120-1, 120-2 . . . 120-N (collectively referred to as dump zones 120), one or more benches 130-1 . . . 130-N (collectively referred to as benches 130), and one or more workshops 140. The quarries 110, the dump zones 120, the benches 130, and the workshops 140 are connected by one or more lanes.

With respect to the mine map 100, a lane may indicate routes along which mining and transportation equipment (not shown) is allowed to operate. A lane is defined as a route having a defined width. The mining and transportation equipment may be allowed to operate within the defined width of the lane, as long as it follows the route. The lanes may be divided into lane segments 160. At various points, the one or more lanes cross each other at intersections 170.

Mining and transportation equipment move along lane segments 160 and intersections 170. Mining and transport equipment include personnel carriers, haul trucks, excavators, loaders, shovels, spray trucks, and so forth. These transport equipment move along the lane segments 160 and intersections 170 to perform one or more mining related activities such as excavation, drilling, and the like.

Each Quarry 110 includes excavation zones 112, and loading points 114. Excavation zones 112 are points in the mine location where the mineral or ore is being extracted from the Earth. Loading points 114 are points in the mine location where the excavated mineral/ore is being loaded into haul trucks.

In an exemplary implementation, each quarry 110 includes an entry point 116 at which the mining and transport equipment enters the quarry 110. Similarly, each quarry 110 also includes an exit point 118 at which the mining and transport equipment exits the quarry 110.

A dump zone 120 is where the excavated mineral/ore is dumped by the haul truck onto a transporter vehicle (such as a train, or a conveyor belt, or trucks, etc.) for processing of the mineral/ore. As depicted in FIG. 1, each dump zone 120 includes an entry point 126 at which the mining and transport equipment enters the dump zone 120. Similarly, each dump zone 120 also includes an exit point 128 at which the mining and transport equipment exits the quarry 120.

A bench 130 is a parking zone for stand-by transport and mining equipment. One or more mining and transport equipment may be parked in a non-operative condition at the benches 130. Further, one or more mining and transport equipment may be moved out from the bench 130 to one of the lane segments 160 for operation.

A workshop 140 is a service area for the transport and mining equipment. Workshop 140 includes typical service stations such as repair station, refueling station, washing station, etc.

Mining and transportation equipment move along lane segments 160 and intersections 170. To improve safety in the mine, movement of the mining and transportation equipment along the lane segments 160 and through the intersections 170 must be coordinated. Safety can be improved by initializing measures to avoid collisions and mishaps, while reducing wait times at intersections, so that productivity of the mine does not suffer. According to various embodiments, a traffic management system (described in the following figures) may be employed.

Mine map 100 may be used by the traffic management system to manage traffic movement in the mine. Traffic management system manages the traffic movement, for example, based on the location, the type, the status, and the destination of the mining and transportation equipment.

In an example, according to vehicle type, different mining and transportation equipment may have an assigned preference ranking. The preference ranking may decide on which transport and mining equipment should be given a right of way and which equipment should be halted. For example, the preference ranking, starting from the highest preference may be given to haul truck, auxiliary vehicles, loaders, drills, and light vehicles. That is, in case of a haul truck and a loader arriving simultaneously at the intersection 170, the haul truck may be given a right to way traffic indicator while the loader may be halted by a stop traffic indicator.

Similarly, preference ranking, in an example, may also be decided according to destination of the mining equipment. For example, a dump zone 120 may have a highest preference ranking followed by, the quarry 110, the workshop 140, and the bench 130. For example, a truck heading to a quarry 110 should get precedence over a truck heading to the workshop 140 when the two arrive at an intersection 170 at the same time.

In another example, preference ranking may be given based on a payload status of the transport and mining equipment. For example, a loaded haul truck should get precedence over an unloaded haul truck, when the two arrive at an intersection 170 at the same time. Similarly, a haul truck should get precedence over a spray truck when the two arrive at an intersection 170 at the same time.

Figure 2:
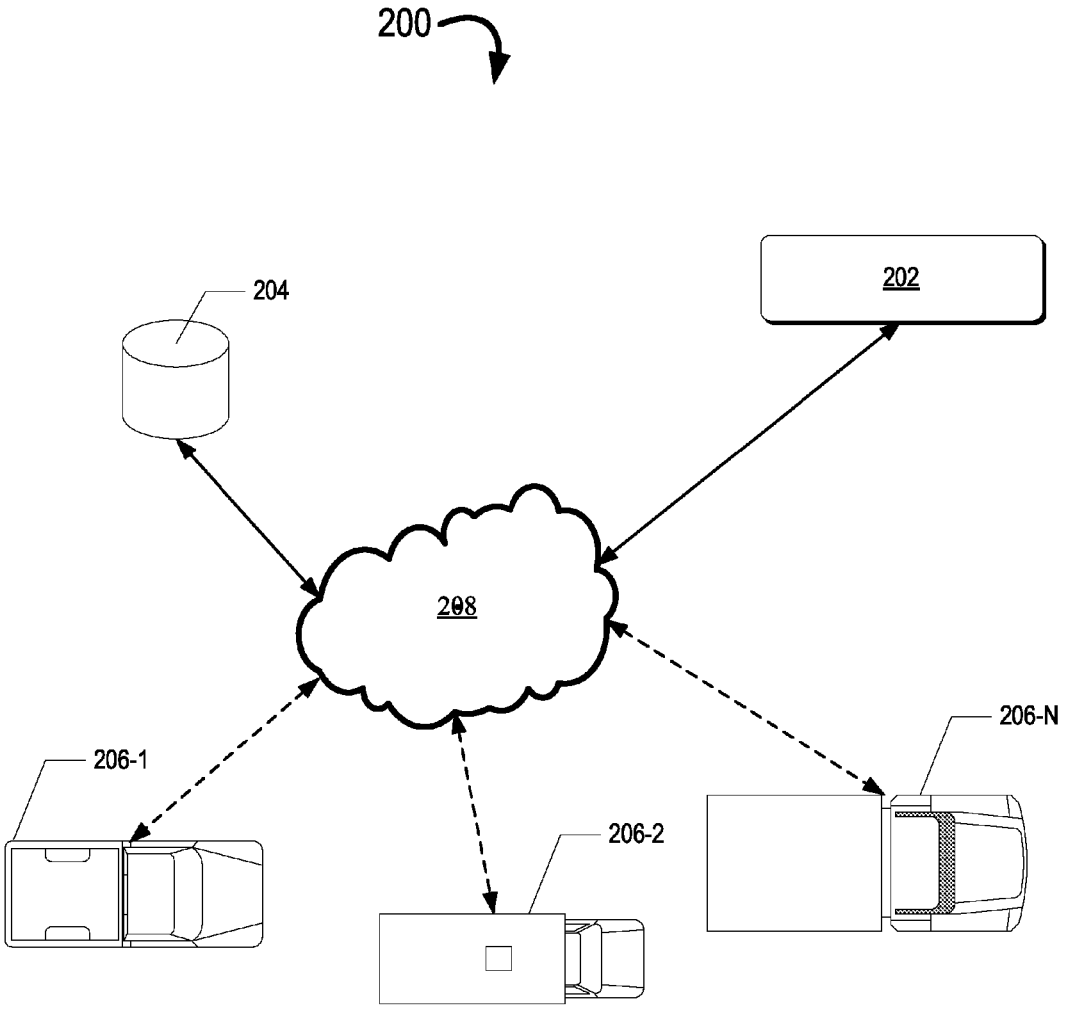
FIG. 2 is an exemplary network implementation of a traffic management system, in accordance with an embodiment of the present disclosure.

FIG. 2 illustrates an exemplary network implementation 200 for implementing a traffic management system 202. Network implementation 200 includes traffic management system 202 interacting with a lane information database 204 and a plurality of vehicles 206-1, 206-2, . . . , 206-N (collectively referred to as the vehicles 206 and individually referred to as the vehicle 206), through a network 208. In an embodiment, traffic management system 202 is described herein as being implemented at a mining location. However, in various alternative embodiments, traffic management system 202 may also be implemented for traffic management at other locations.

Traffic management system 202 manages the plurality of vehicles 206 moving in synchronization at a mining location. Traffic management system 202 includes one or modules (not shown) for deploying various traffic management activities within the mining location, such as fleet management, route clearance, lane management, equipment management, and the like. For example, traffic management system 202 may be deployed for managing one or more trucks and/or excavation machines for a plurality of activities like dumping, loading and/or unloading, hauling, and the like. In another example, traffic management system 202 may be deployed for lane management, when the plurality of vehicles 206 moves in synchronization within lanes having one or more intersections, within the mining location.

Traffic management system 202 interacts with lane information database 204, for obtaining one or more parameters associated with a plurality of lanes in between which the plurality of vehicles 206 moves. Lane information database 204 stores information related to lanes, such as, cross-section area of lanes, number of intersections in a lane, end points of lanes, workshop and worksite locations, dumping locations, and the like. Lane information database 204 also includes a dynamic mine map (such as the mine map 100) depicting locations of the plurality of vehicles 206, movement of the plurality of vehicles 206 at lane intersections 170 (shown in FIG. 1), and the like. Lane information database 204 may be a conventional database having one or more data storage devices (not shown) for storing the lane information. The data store may also include one or more applications built in for communicating with traffic management system 202 over network 208.

For effective management of traffic within lanes at the mining location, traffic management system 202 continuously monitors status of the plurality of vehicles 206. The status of the plurality of vehicles 206 may include, without limitation, a payload status, a destination status, a working cycle status, and the like. The status differs based on a type of the vehicle 206. Type of the vehicle 206 may include, without limitation, haul trucks, loaders, drills, dozers, pickup trucks, auxiliary vehicles and the like. For example, traffic management system 202 may monitor whether a haul truck is loaded or unloaded, destination of the haul truck, e.g. workshop 140 or a dump zone 120, and the like for the vehicle 206. In an embodiment, traffic management system 202 obtains location information of the vehicle 206 wirelessly over network 208. The location information of the vehicle 206 is obtained by a Global Positioning Satellite (GPS) device (not shown) installed within the vehicle 206. The location information of the vehicle 206 includes the geographical coordinates of the vehicle 206 and position of the vehicle 206 with respect to other vehicles moving within the mining location. In another embodiment, traffic management system 202 also receives vehicle identifiers for each of the plurality of vehicles 206. The vehicle identifiers may include, without limitation, registration numbers, GPS identifiers, Vehicle Identification Numbers (VIN), and the like.

In an embodiment, traffic management system 206 generates traffic indicators for the vehicles 206, based on the status of the vehicles 206, location information of the vehicles 206, and vehicle identifiers of the vehicles 206; and transmits the traffic indicators to the vehicles wirelessly over network 208. These traffic indicators include a Right of Way (ROW) traffic indicator, a Stop traffic indicator, a Yield traffic indicator, and a Null traffic indicator.

In a moving traffic, a ROW traffic indicator may indicate that a vehicle can continue moving in a designated lane segment 160, even if the vehicle encounters an intersection 170. Thus, the vehicle may have a high priority on all other vehicles moving in the traffic. A stop traffic indicator may indicate that a vehicle has to stop when the vehicle encounters an intersection 170. A yield traffic indicator may indicate that the vehicle may continue moving through a lane intersection 170, as long as there is no other vehicle at the intersection. If there is any other vehicle at the intersection, the vehicle with the yield traffic indicator must stop and give way to the other vehicle. A null traffic indicator may indicate that the lane segment in which the vehicle is moving does not have a forthcoming intersection.

Network 208 may be a wireless or a wired network, or a combination of wireless and wired networks. Network 208 can be a collection of individual networks, interconnected with each other and functioning as a single large network (e.g., the internet or an intranet). Examples of such individual networks may include, without limitation, Local Area Networks (LANs), Wide Area Networks (WANs), and Metropolitan Area Networks (MANs). Network 208 includes suitable hardware and/or software components (not shown) to communicatively couple lane information database 204 and the vehicles 206 to traffic management system 202.

Figure 3:
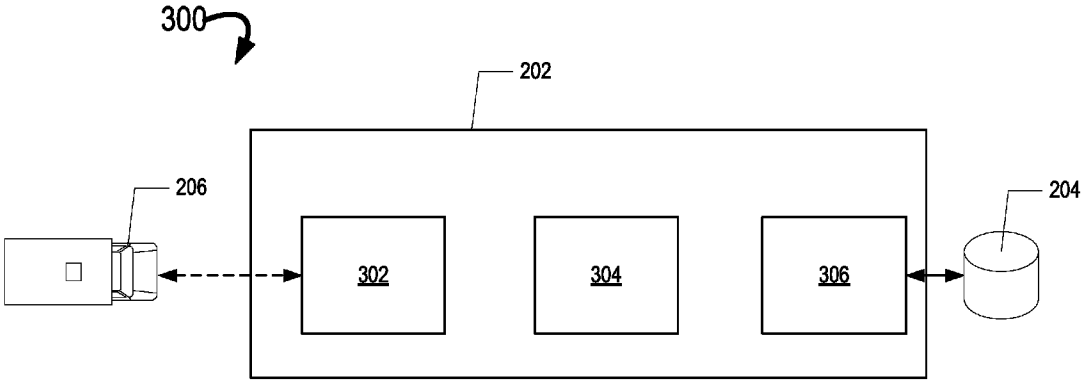
FIG. 3 illustrates a block diagram for working of the traffic management system, in accordance with an embodiment of the present disclosure.

FIG. 3 illustrates a block diagram 300 for working of traffic management system 202. As depicted, traffic management system 202 includes a receiving module 302, a status module 304, and a traffic management module 306. Receiving module 302 is communicatively coupled to the vehicle 206, through a wireless link, as shown by a double-arrowed dotted line. FIG. 3 illustrates receiving module 302 communicatively coupled only to a single vehicle, however, in alternate embodiments, receiving module 302 may be coupled to a plurality of vehicles in the mining location.

Receiving module 302 receives location information of the vehicle 206 and a vehicle identifier of the vehicle 206, from the vehicle 206, through the wireless link. In an example, the location information of the vehicle 206 is received from a GPS device (not shown) installed within the vehicle 206. The location information of the vehicle 206 includes data pertaining to geographical coordinates of the vehicle 206 and location of the vehicle 206 with respect to other vehicles moving in synchronization of the vehicle 206. The location information associated with the vehicle 106 is received for a lane, a lane end or a lane intersection. For example, the location information may depict whether the vehicle 206 is headed towards a lane intersection, a lane end or is simply moving in a straight lane. The vehicle identifier may include, without limitation, vehicle registration numbers, vehicle identification numbers, GPS identifiers of the vehicle, and the like.

Subsequent to receiving of the location information of the vehicle 206, status module 304 determines a current status of the vehicle 206. Current status of the vehicle may include, without limitation, a payload status and a destination status of the vehicle 206. For example, status module 206 may determine whether a vehicle is loaded, unloaded, undergoing loading or unloading process, and the like. In another example, status module 304 may determine a destination of the vehicle 206. The destination of the vehicle may include, without limitation, workshops, worksites, dumping areas, vehicle yards, and the like. In an embodiment, the current status of the vehicle 206 is determined based on the location information of the vehicle 206. For example, status module 306 may determine whether the vehicle 206 is moving towards a lane intersection 170, a dump zone 120, a workshop 140, etc. (shown in FIG. 1). based on the location information of the vehicle 206 received by receiving module 302. In another embodiment, status module 304 receives status updates related to the plurality of vehicles 206 such as a payload status update, a destination status update and the like.

In an embodiment, status module 304 is configured to determine whether the vehicle 206 is within a defined distance from a lane intersection 170. In an example, status module 304 may determine whether the vehicle 206 is within the defined distance from the lane intersection 170, based on the location information of the vehicle 206 and the mine map 100, as depicted in FIG. 1. For example, status module 304 may compare the geographical coordinates of the vehicle 206 with the geographical coordinates of the lane intersection 170 to determine whether the vehicle 206 is within the defined distance from the lane intersection 170. In another example, status module 304 may utilize variables such as the vehicle identifier to identify the vehicle type; the payload status to determine whether the vehicle is loaded, unloaded, or partially loaded; and a speed of the vehicle based on the vehicles GPS tracking. The status module 304 may then determine a stopping distance based on the vehicle type, the payload status of the vehicle, and the speed of the vehicle, or any combination thereof, and set the defined distance based on the determined stopping distance. The defined distance in this case, will be larger than the stopping distance.

The defined distance, may be different for different types of vehicles and may be defined on one or more parameters associated with the different types of vehicles. The one or more parameters for a vehicle may include, without limitation, speed of the vehicle, payload of the vehicle, stopping distance required by the vehicle and the like. For example, a loaded haul truck may require more stopping distance than an unloaded haul truck. In another example, for two vehicles having same payload, vehicle moving with faster speed will require more stopping distance than vehicle moving with a lesser speed.

Traffic management module 306 is configured to generate one or more traffic indicators based on the location information and the current status of the vehicle 206. The traffic indicators are one of a ROW traffic indicator, a Stop traffic indicator, a Null traffic indicator, or a Yield indicator. In an embodiment, traffic management module 306 generates the traffic indicator and transmits the generated traffic indicator to the vehicle 206 when the vehicle 206 is within the defined distance from the intersection. For example, based on precedence when a haul truck and a motor grader arrive at a lane intersection at the same time, the haul truck may be given preference. At such an instance, the haul truck may be given a ROW traffic indicator, while the motor grader may be given a STOP traffic indicator. Similarly, in case where a lane does not have lane intersections, a vehicle moving on that lane may be given a NULL traffic indicator, indicating the vehicle to continue moving. Thus, in one embodiment, as a vehicle travels and approaches an intersection 170 along the lane segments 160, traffic indicators are changed as each machine reaches a pre-defined distance from the intersection 170.

INDUSTRIAL APPLICABILITY

Traffic management system 202 described herein can be implemented in various locations where one or more vehicles move in synchronization with each other. Traffic management system 202 can be used to transmit traffic indicators to vehicles, such as, haul trucks, dozers, drills, etc. working at a mining location. The traffic indicators can be ROW, Stop, Yield, and Null. Thus, traffic management system 202 provides the benefits of automated and efficient fleet management, traffic management, lane management and the like for a mining location, thus providing for operator-free, safe, and economical operations at the mining location.

Figure 4:
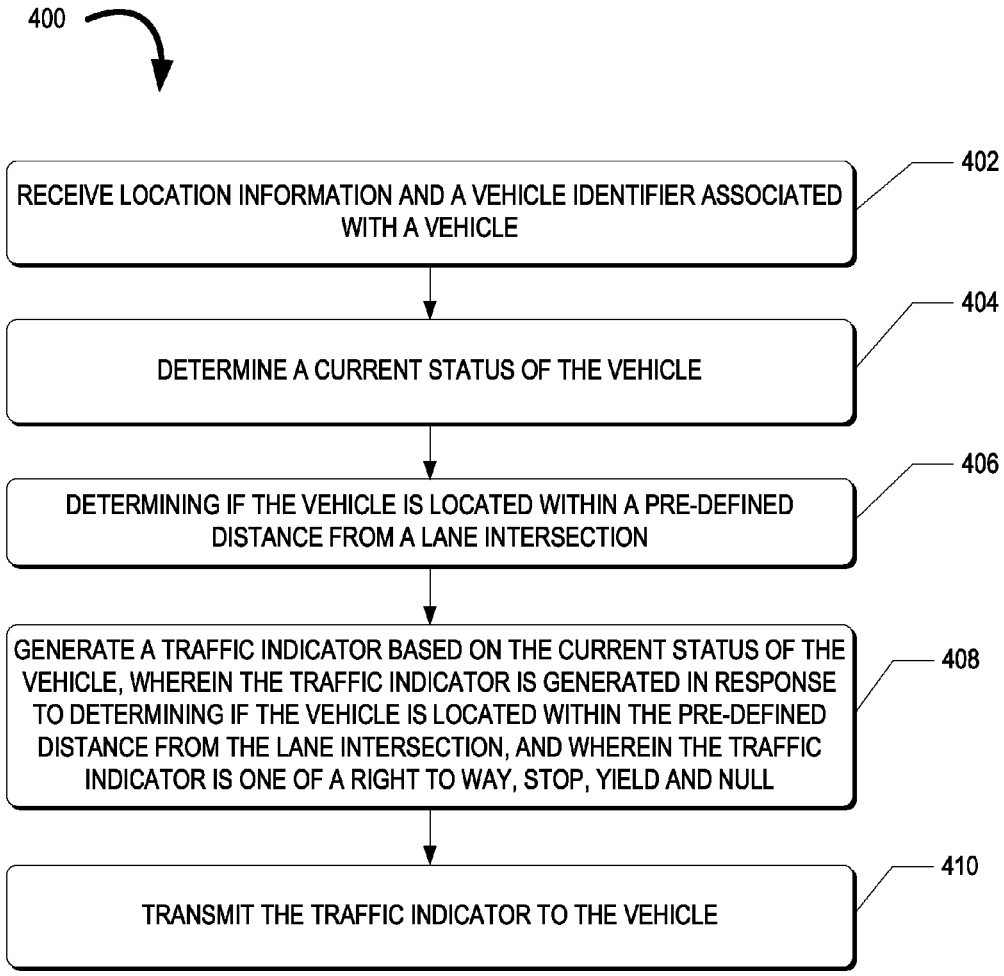
FIG. 4 illustrates an exemplary process flow for traffic management, in accordance with an embodiment of the present disclosure.

FIG. 4 illustrates a process flow 400 for traffic management. The process flow starts at step 402 where location information and a vehicle identifier associated with the vehicle 206 is received. The location information and the vehicle identifier are received by receiving module 302 of traffic management system 202. The location information of the vehicle is obtained from a GPS device integrated within the vehicle 206. The vehicle identifier may be a registration number, GPS ID, VIN, etc. of the vehicle.

At step 404, a current status of the vehicle 206 is determined. The current status of the vehicle 206 may include payload status, destination status, working cycle status, and the like for the vehicle 206. The current status of the vehicle 206 is determined by status module 304 of traffic management system 202.

At step 406, it is determined whether the vehicle 206 is located within a pre-defined distance from a lane intersection 170. The location of the vehicle in terms of the lane intersection 170 may be determined, by status module 304, using the location information of the vehicle 206 and the mine map obtained from lane information database 204.

At step 408, a traffic indicator is generated based on the current status of the vehicle 206. The traffic indicator is generated by traffic management module 306, when the vehicle 206 is located within the defined distance from the lane intersection 170. The traffic indicator is one of a ROW indicator, a stop indicator, a yield indicator, or a null indicator.

At step 410, the generated traffic indicator is transmitted back to the vehicle 206.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

The invention claimed is:

1. A method for traffic management comprising:

receiving location information and a vehicle identifier associated with a vehicle;

determining a current status of the vehicle, wherein the current status comprises a payload status of the vehicle;

determining if the vehicle is located within a defined distance from a lane intersection;

generating a traffic indicator based on the current status of the vehicle, when the vehicle is located within the defined distance from the lane intersection, wherein the traffic indicator is one of a Right to Way, Stop, Yield and Null; and transmitting the traffic indicator to the vehicle.

2. The method of claim 1, wherein the location information associated with the vehicle is received from a Global Positioning Satellite device.

3. The method of claim 1, wherein the vehicle identifier further comprises at least a type of the vehicle.

4. The method of claim 1, wherein the current status of the vehicle is determined based on the location information associated with the vehicle.

5. The method of claim 1, wherein the current status of the vehicle further comprises a destination of the vehicle.

6. The method of claim 5, the destination of the vehicle is at least one of a quarry, a dump zone, a workshop or a bench.

7. The method of claim 5, wherein the destination of the vehicle is determined based on the location information associated with the vehicle.

8. The method of claim 1, further comprising receiving status updates associated with the vehicle.

9. The method of claim 1, wherein the location information associated with the vehicle is received for at least one of a lane, a lane intersection or a lane end.

10. A traffic management system comprising:

a receiving module configured to receive location information and a vehicle identifier associated with a vehicle, and further configured to transmit a traffic indicator to the vehicle;

a status module configured to:

determine a current status of the vehicle, wherein the current status comprises a payload status of the vehicle; and determine if the vehicle is located within a defined distance from a lane intersection; and a traffic management module configured to:

generate the traffic indicator based on the current status of the vehicle, when the vehicle is located within the defined distance from the lane intersection, wherein the traffic indicator is one of a Right to Way, Stop, Yield and Null.

11. The traffic management system of claim 10, wherein the receiving module is configured to receive the location information associated with the vehicle from a Global Positioning Satellite device.

12. The traffic management system of claim 10, wherein the vehicle identifier comprises at least a type of the vehicle.

13. The traffic management system of claim 10, wherein the status module is configured to determine the current status of the vehicle based on the location information associated with the vehicle.

14. The traffic management system of claim 10, wherein the current status of the vehicle further comprises a type of the vehicle and a destination of the vehicle.

15. The traffic management system of claim 14, wherein the destination of the vehicle is at least one of a quarry, a dump zone, a workshop or a bench.

16. The traffic management system of claim 15, wherein the destination of the vehicle is determined based on the location information associated with the vehicle.

17. The traffic management system of claim 10, wherein the status module is further configured to receive status updates associated with the vehicle.

18. The traffic management system of claim 10, wherein the receiving module receives the location information associated with the vehicle for at least one of a lane, a lane intersection or a lane end.

* * * * *